US009607789B1

(12) United States Patent
Hodea

(10) Patent No.: US 9,607,789 B1
(45) Date of Patent: Mar. 28, 2017

(54) SWITCH ASSEMBLY AND METHOD OF OPERATING SAME

(71) Applicant: DELTA SYSTEMS, INC., Streetsboro, OH (US)

(72) Inventor: Sorin Hodea, North Canton, OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 14/577,479

(22) Filed: Dec. 19, 2014

Related U.S. Application Data

(60) Provisional application No. 61/918,937, filed on Dec. 20, 2013.

(51) Int. Cl.

| | |
|---|---|
| ***H01H 13/58*** | (2006.01) |
| ***H01H 13/14*** | (2006.01) |
| ***H01H 11/00*** | (2006.01) |
| ***H01H 13/10*** | (2006.01) |
| *H01H 13/52* | (2006.01) |

(52) U.S. Cl.
CPC ..... *H01H 13/58* (2013.01); *H01H 11/00* (2013.01); *H01H 13/10* (2013.01); *H01H 13/14* (2013.01); *H01H 2013/525* (2013.01); *H01H 2201/004* (2013.01); *H01H 2207/004* (2013.01); *H01H 2219/062* (2013.01); *H01H 2221/044* (2013.01);
(Continued)

(58) Field of Classification Search
CPC ..... H01H 13/58; H01H 13/023; H01H 13/10; H01H 13/562; H01H 3/00; H01H 3/02; H01H 3/12; H01H 3/54; H01H 3/32; H01H 9/00; H01H 9/02; H01H 13/00; H01H 13/04; H01H 13/08; H01H 13/12; H01H 13/14; H01H 13/20; H01H 13/36; H01H 13/38; H01H 13/40; H01H 13/46; H01H 13/50; H01H 2003/00; H01H 2003/02; H01H 2003/161; H01H 2003/32; H01H 2013/04; H01H 2013/50; H01H 2221/03; H01H 2223/00; H01H 2233/00; H01H 2221/078; H01H 2221/066; H01H 2239/05; H05K 5/00
USPC ..... 200/447, 405, 16 R, 16 B, 16 C, 16 F, 200/48 KB, 400, 434, 439, 537–540, 554, 200/254, 530, 43.04, 526, 524, 531, 314
See application file for complete search history.

(56) References Cited

U.S. PATENT DOCUMENTS 5,001,316 A * 3/1991 Salaman ..... H01H 13/585 200/11 DA
5,221,816 A 6/1993 Williams
(Continued)

*Primary Examiner* — Anthony R. Jimenez
(74) *Attorney, Agent, or Firm* — Tarolli, Sundheim, Covell & Tummino LLP

(57) ABSTRACT

A switch assembly and method of operation comprises a housing having top and bottom ends spaced about a longitudinal axis and a selectively movable knob coupled to a plunger arrangement having a shaft that extends from inside the housing to couple to the knob. The switch assembly also comprises a printed circuit board having at least one wiper for engaging a contact extending from the plunger arrangement. A step shaft projects from the shaft of the plunger arrangement such that when a maintained mode of operation is desired by the switch assembly, the step shaft engages a retaining assembly formed by a portion of the housing, and when a momentary mode of operation is desired by the switch assembly the step shaft is positioned such that is free from engaging the retaining assembly.

20 Claims, 14 Drawing Sheets

(52) U.S. Cl.
CPC . *H01H 2221/052* (2013.01); *H01H 2235/026* (2013.01)

(56) References Cited

U.S. PATENT DOCUMENTS

| | | | | |
|---|---|---|---|---|
| 5,528,007 | A | 6/1996 | Williams et al. | |
| 5,613,598 | A | 3/1997 | Pittman et al. | |
| 5,727,675 | A * | 3/1998 | Leveque ..... | H01H 13/023 200/314 |
| 5,775,482 | A | 7/1998 | Wolfe et al. | |
| 6,207,910 | B1 | 3/2001 | Harvey et al. | |
| 6,483,061 | B1 | 11/2002 | Harvey et al. | |
| D472,883 | S | 4/2003 | Harvey | |
| 6,618,022 | B2 | 9/2003 | Harvey | |
| 7,488,914 | B2 | 2/2009 | Kahnert et al. | |
| 7,629,543 | B2 | 12/2009 | Kahnert | |
| 8,256,197 | B2 | 9/2012 | Kahnert | |
| 8,921,724 | B2 | 12/2014 | Young | |

* cited by examiner

SWITCH ASSEMBLY AND METHOD OF OPERATING SAME

CROSS REFERENCES TO RELATED APPLICATIONS

The following application claims priority under 35 U.S.C. §119(e) to co-pending U.S. Provisional Patent Application Ser. No. 61/918,937 filed Dec. 20, 2013 entitled SWITCH ASSEMBLY AND METHOD OF OPERATING SAME. The above-identified application is incorporated herein by reference in its entirety for all purposes.

TECHNICAL FIELD

The present disclosure relates to electrical switches, and more particularly to a switch assembly and method of operation that includes a plunger arrangement having a selectable mode operation between a momentary operating condition and a maintained mode of operation.

BACKGROUND

Electrical switches using push button or plunger type switch actuators have many applications including use in automobile car doors, ignition circuits, power take-offs for lawn mowers and garden tractors, refrigerator doors, home appliances, and the like. These push buttons may be normally open, normally closed or a combination of the two.

It is possible to construct switches having more than two terminals, which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Further discussion relating to the different switch constructions can be found in U.S. Pat. No. 5,528,007 entitled PLUNGER SNITCH AND METHOD OF MANUFACTURE that issued on Jun. 18, 1996 and assigned to the assignee of the present disclosure. U.S. Pat. No. 5,528,007 is incorporated herein by reference in its entirety.

SUMMARY

One example embodiment of the present disclosure includes a switch assembly and method of operation comprising a housing having top and bottom ends spaced about a longitudinal axis and a selectively movable knob coupled to a plunger arrangement having a shaft that extends from inside the housing to couple to the knob. The switch assembly also comprises a printed circuit board having at least one wiper for engaging a contact extending from the plunger arrangement. A step shaft projects from the shaft of the plunger arrangement such that when a maintained mode of operation is desired by the switch assembly, the step shaft engages a retaining assembly formed by a portion of the housing, and when a momentary mode of operation is desired by the switch assembly the step shaft is positioned such that is free from engaging the retaining assembly.

Another example embodiment of the present disclosure includes a method of constructing a switch assembly to operate between a maintained operating mode and a momentary operating mode, the method comprises the steps of providing a housing having top and bottom ends spaced about a longitudinal axis, attaching a selectively movable knob to a plunger arrangement having a shaft that extends from inside the housing; securing a contact to the shaft for selectively engaging a wiper on a printed circuit board, the contact being momentarily engaged mode or in a maintained engaged mode based on the orientation of a step shaft projecting from the shaft when the switch assembly is assembled; and selectingly orienting the step shaft to engage with a retaining assembly formed by a portion of the housing in a maintained mode of operation of the switch assembly or selectively orienting the step shaft freely from engaging the retaining assembly when a momentary mode of operation of the switch assembly.

While another example embodiment of the present disclosure comprises a switch assembly having: a housing forming a cavity spaced about a longitudinal axis, a selectively movable knob coupled to a plunger arrangement having a shaft that extends from inside the housing to couple to the knob; a printed circuit board having at least one wiper for engaging a contact extending from the plunger arrangement; and an asymmetrical step shaft comprising first and second arms of differing length projecting from the shaft of the plunger arrangement that when a maintained mode of operation is desired by the switch assembly, the first arm of step shaft having a greater length engages a retaining assembly formed in one of a plurality of walls forming the cavity of the housing, and when a momentary mode of operation is desired by the switch assembly the second arm of the step shaft having a lesser length is positioned such that is free from engaging the retaining assembly.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

Figure 2:
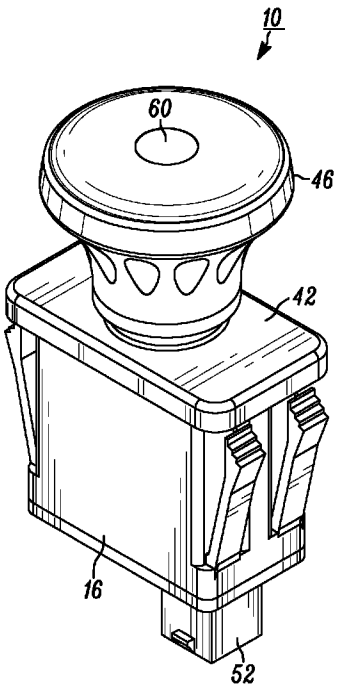
FIG. 2 is a second top perspective view of a switch assembly constructed in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to electrical switches, and more particularly to a switch assembly and method of operation that includes a plunger arrangement having a selectable mode operation between a momentary operating condition and maintained mode of operation.

Figure 1:
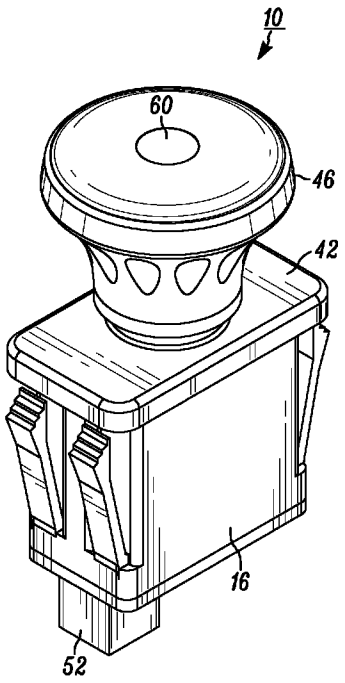
FIG. 1 is a first top perspective view of a switch assembly constructed in accordance with one example embodiment of the present disclosure.
Figure 4:
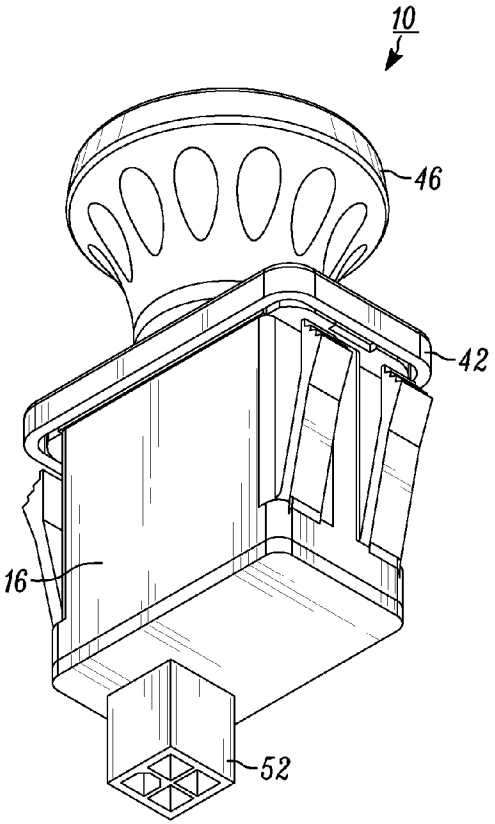
FIG. 4 is a second bottom perspective view of a switch assembly constructed in accordance with one example embodiment of the present disclosure.
Figure 3:
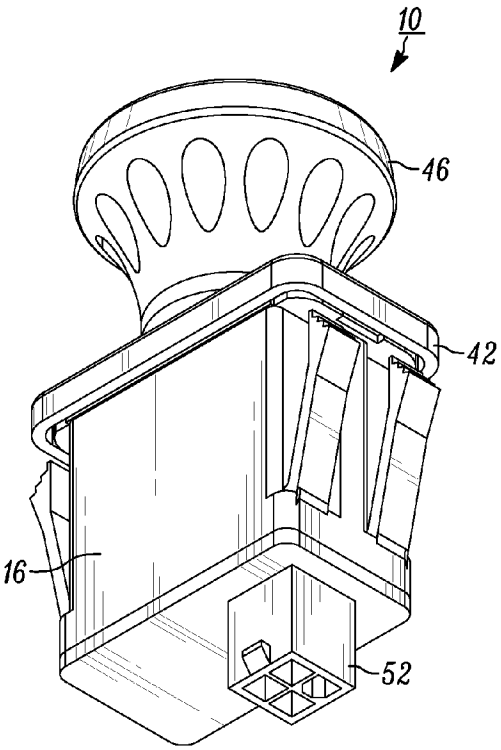
FIG. 3 is a first bottom perspective view of a switch assembly constructed in accordance with one example embodiment of the present disclosure.
Figure 8:
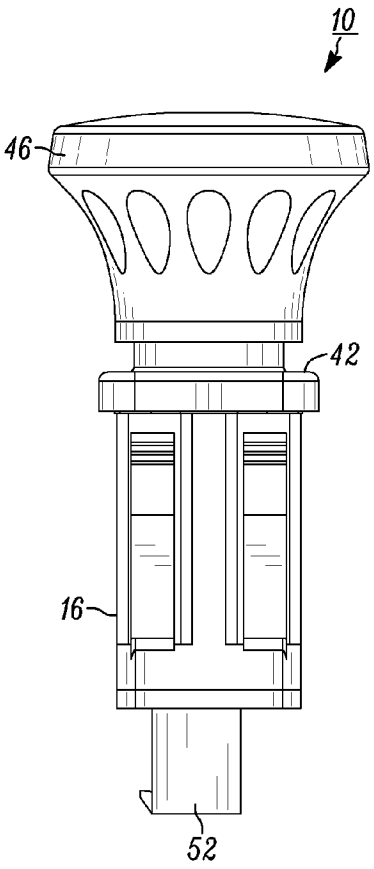
FIG. 8 is a second side elevation view of FIG. 5.
Figure 7:
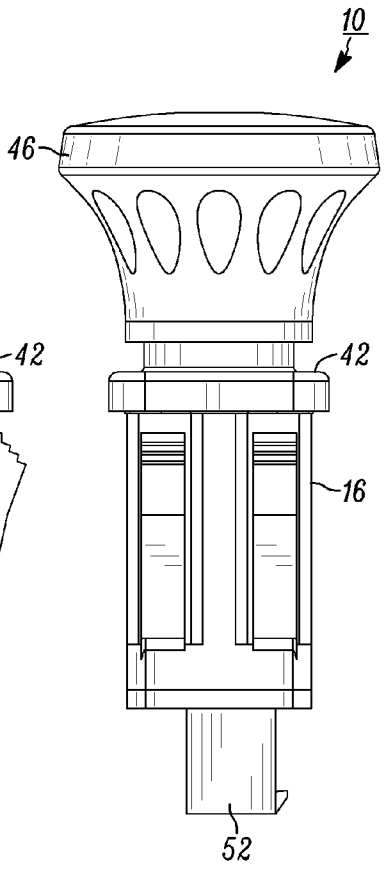
FIG. 7 is a first side elevation view of FIG. 5.
Figure 6:
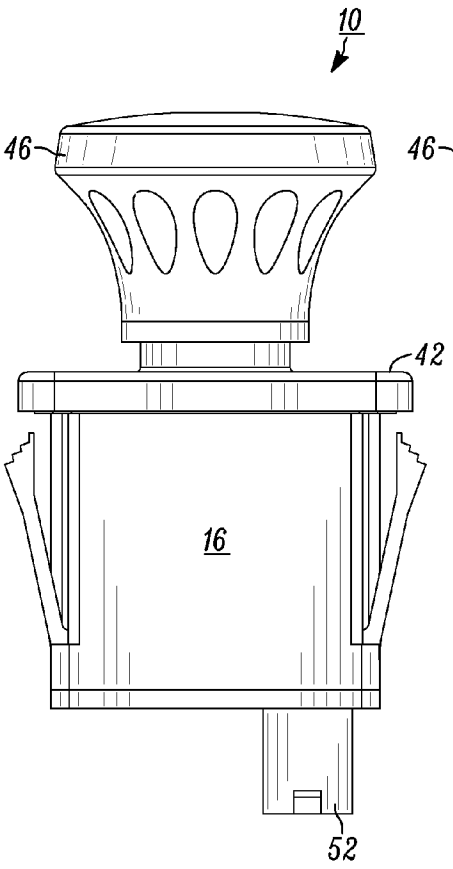
FIG. 6 is a rear elevation view of FIG. 5.
Figure 5:
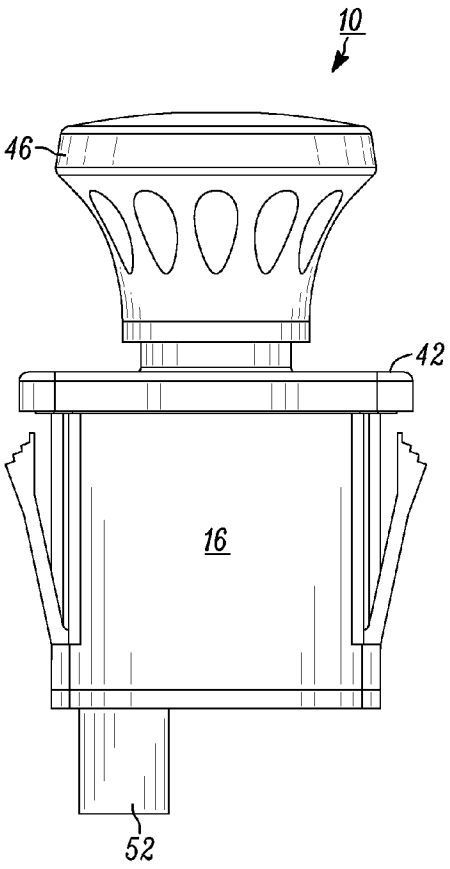
FIG. 5 is a front elevation view of FIG. 1.
Figure 10:
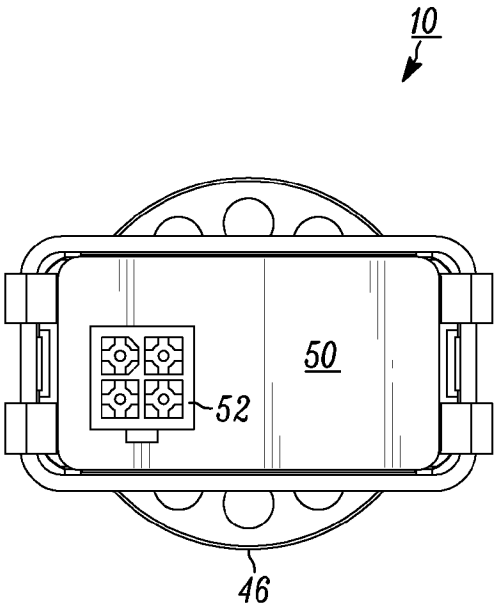
FIG. 10 is a bottom plan view of FIG. 5.
Figure 9:
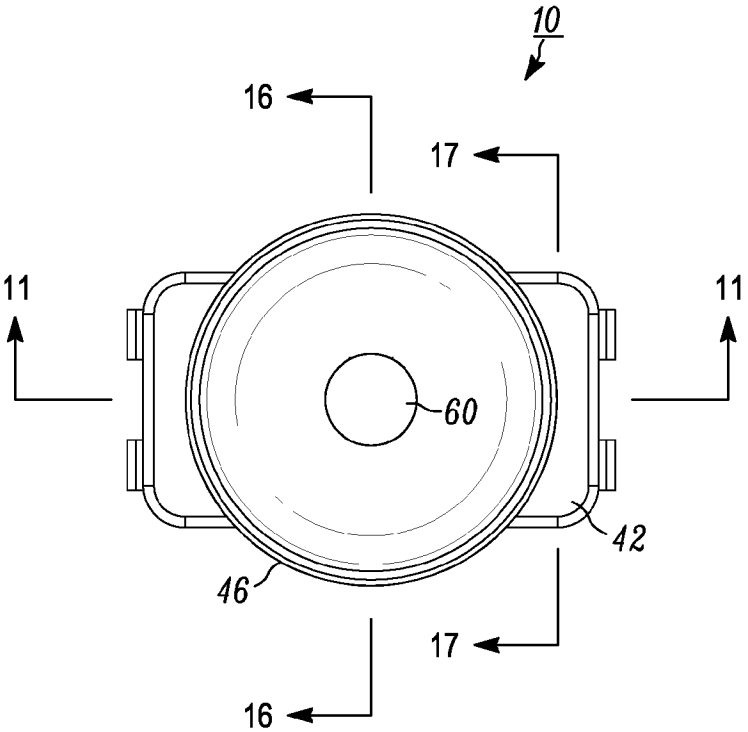
FIG. 9 is a top plan view of FIG. 5.
Figure 11:
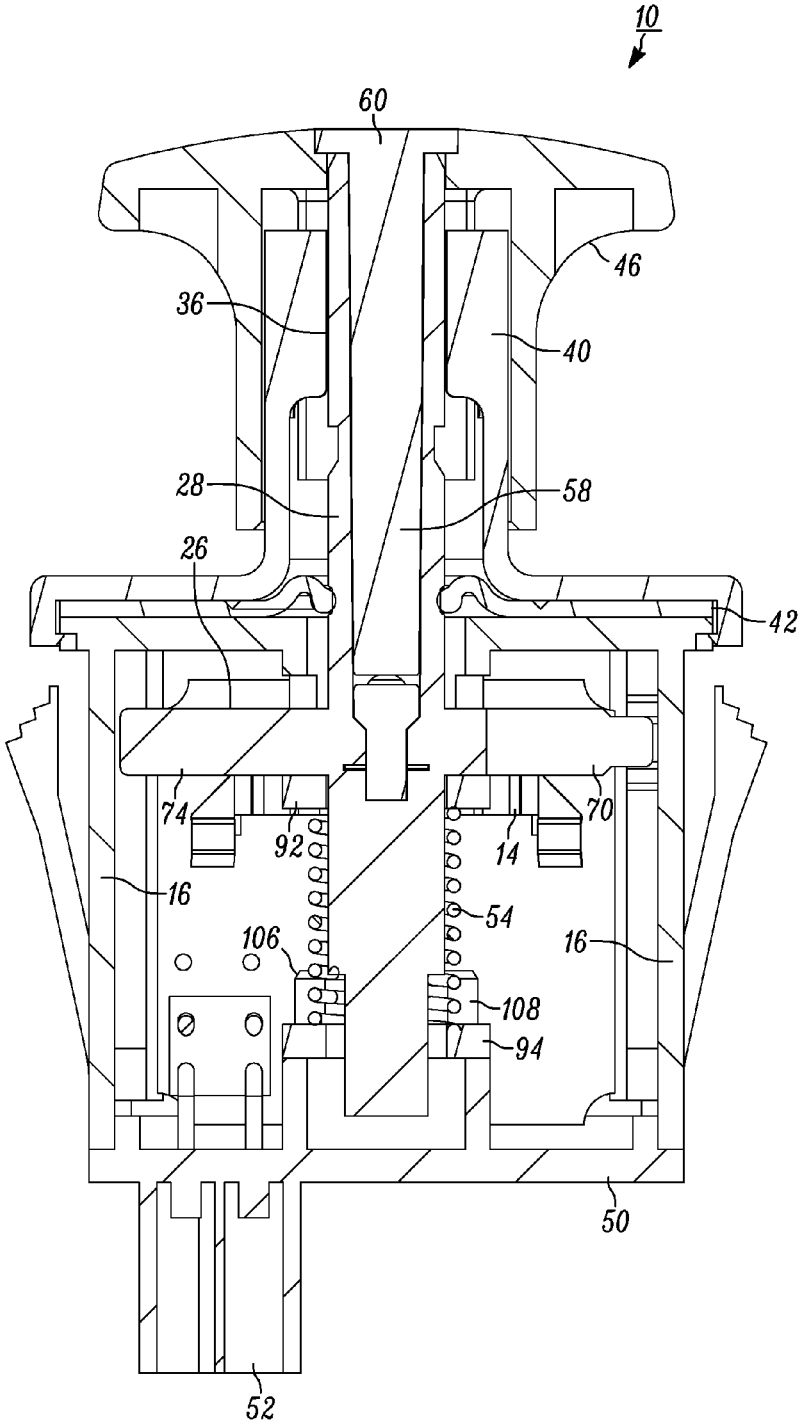
FIG. 11 is a front elevation section view along section lines 11-11 illustrated in FIG. 9.

FIG. 1 illustrates a perspective view of switch assembly 10 constructed in accordance with one example embodiment of the present disclosure. The switch assembly 10 as would be appreciated by one of ordinary skill in the art operates in both a normally open "NO" or normally closed "NC", single-pole double-throw, and doable-pole double-throw configurations, based on the construction of the contact combinations with respective terminals, as further discussed below and in U.S. Pat. Nos. 5,528,007 and 5,221,816, which are incorporated herein by reference in their entireties.

Figure 20:
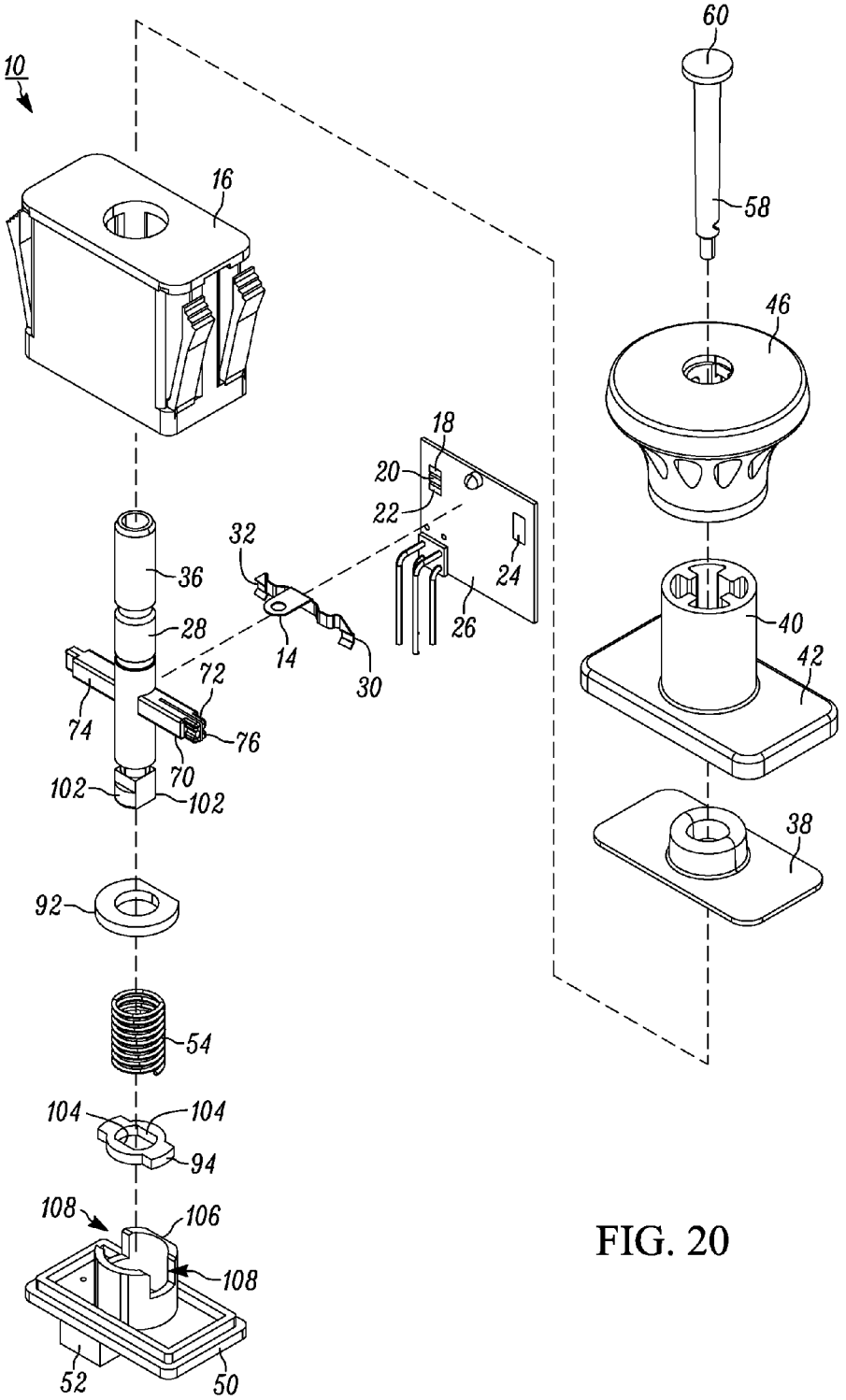
FIG. 20 is a front exploded assembly view of FIG. 5.
Figure 21:
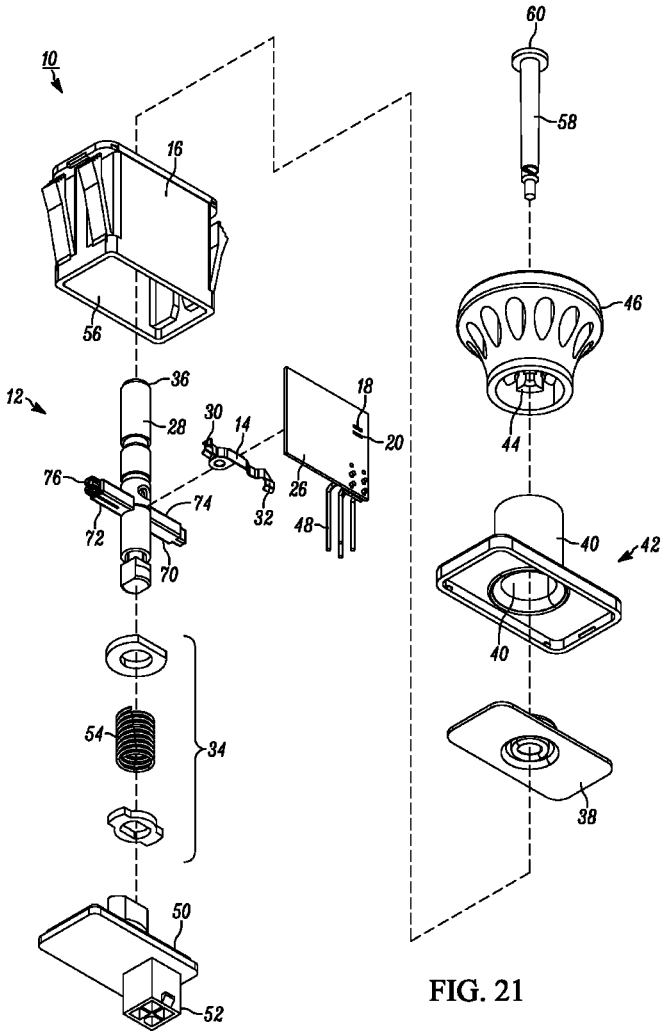
FIG. 21 is a rear exploded assembly view of FIG. 5.

The NO, NC, and other various electrical state changes and are dependent on the location of a plunger arrangement 12 and a contact 14 located thereon as it is moved within a housing 16, as shown in the assembly views of FIGS. 20 and 21. The electrical states change as the contact 14 is moved by the plunger arrangement 12 over various wiper contacts 18, 20, 22, and 24 that are positioned on a printed circuit board (PCB) 26 that is also part of the switch assembly 10 and is located within the housing 16. The contact 14 closes or opens the circuit between wipers 18, 20, 22 and wiper 24.

The plunger arrangement 12 comprises a shaft 28, the contact 14 having first and second contact points 30 and 32, respectively, and a spring assembly 34, as illustrated in FIGS. 20 and 21. The shaft 28 has an upper end 36 that passes along a longitudinal axis (shown in dashed lines) of the switch assembly 10 and housing 16 through a seal 38 that keeps debris from entering the housing, and further passes through, and is guided in a sleeve 40 in a housing top 42. The upper end 36 is then secured into a catch 44 molded into a knob 46. The catch 44 includes a snap fit or press fit connection with the upper end 36 that becomes permanently fixedly attached with the knob 46 when pressed together as would be appreciated by one of ordinary skill in the art.

Figure 14:
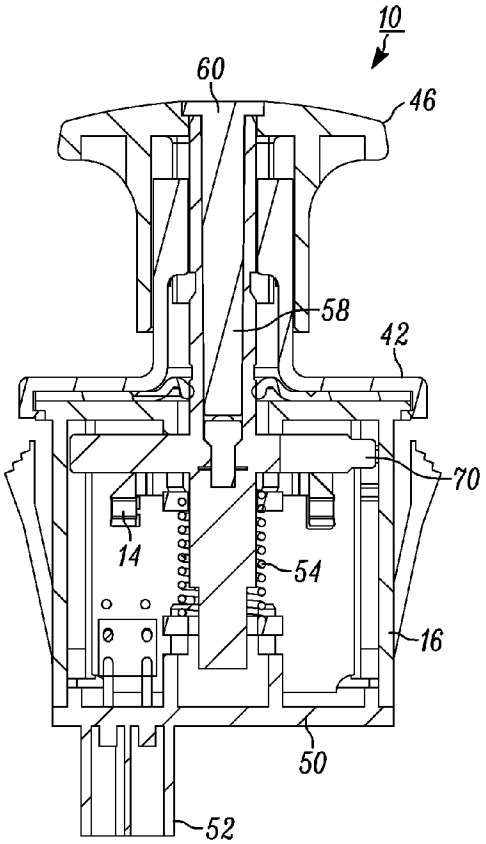
FIG. 14 is a sectional view of a switch assembly in a up position.
Figure 13:
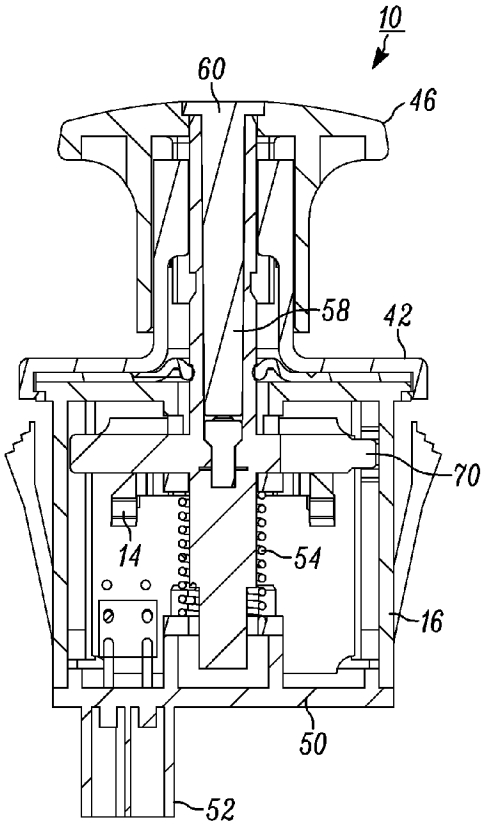
FIG. 13 is a sectional view of a switch assembly in a middle position.
Figure 12:
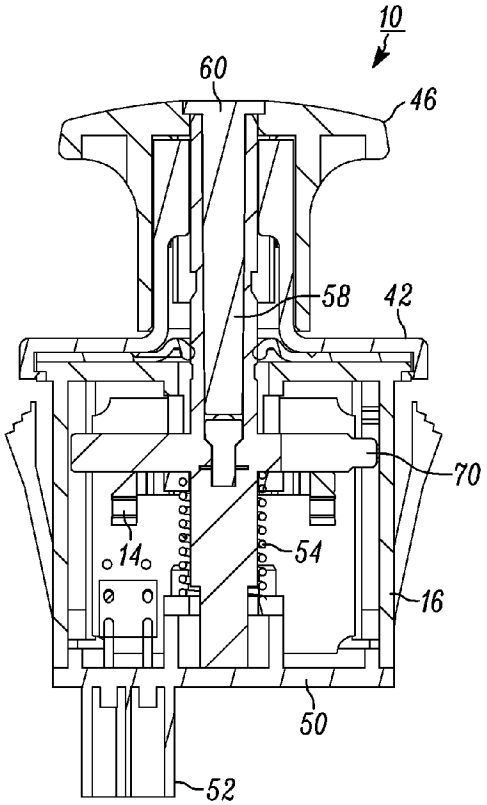
FIG. 12 is a sectional view of a switch assembly in a down position.
Figure 15:
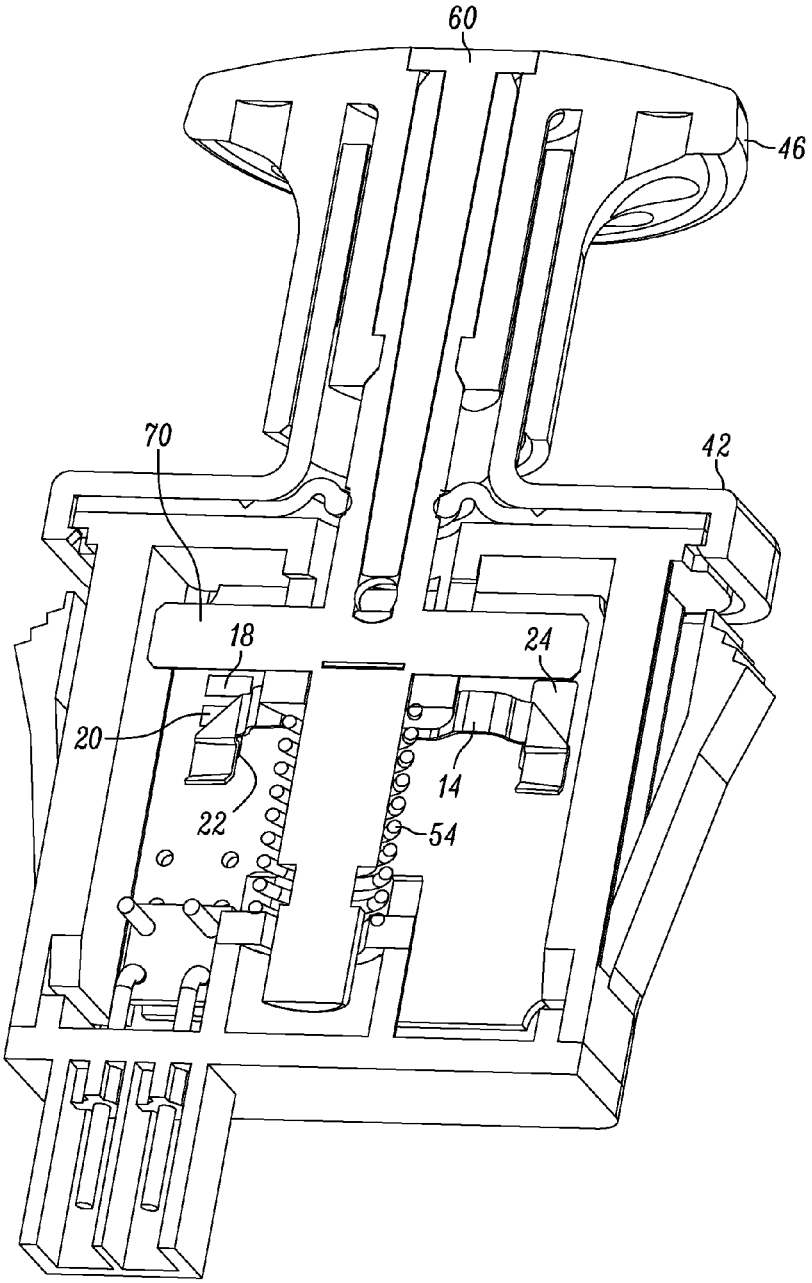
FIG. 15 is another sectional view of the switch assembly of FIG. 11.
Figure 16:
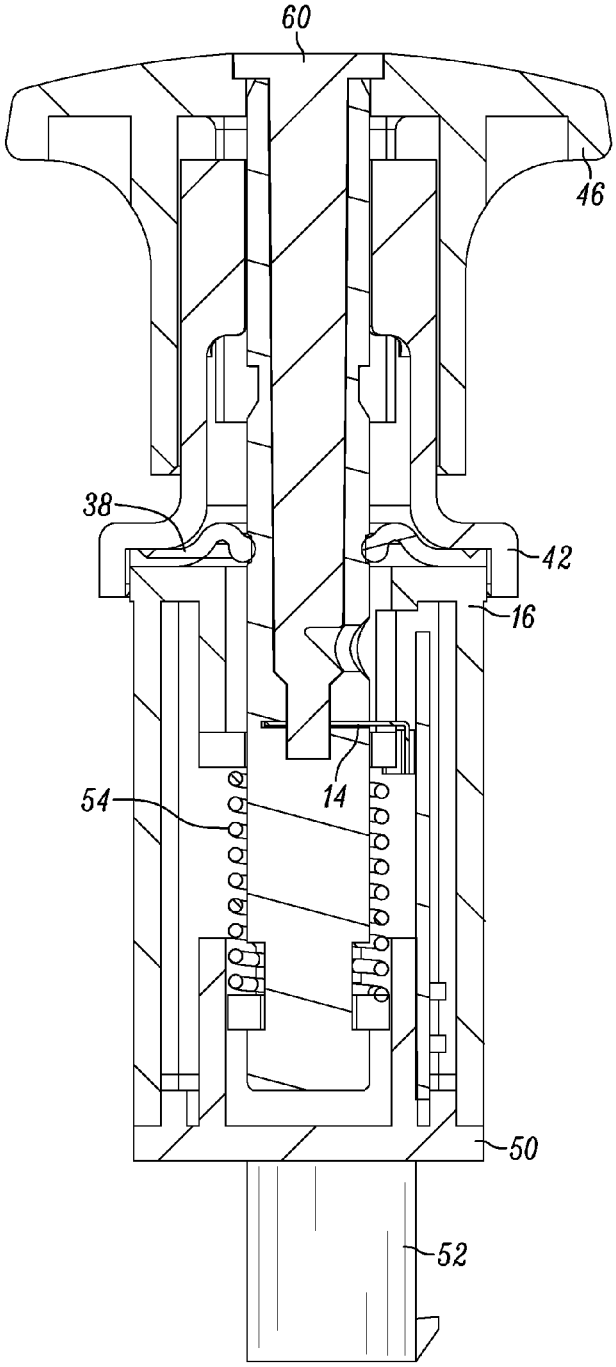
FIG. 16 is a side elevation section view along section lines 16-16 illustrated in FIG. 9.
Figure 17:
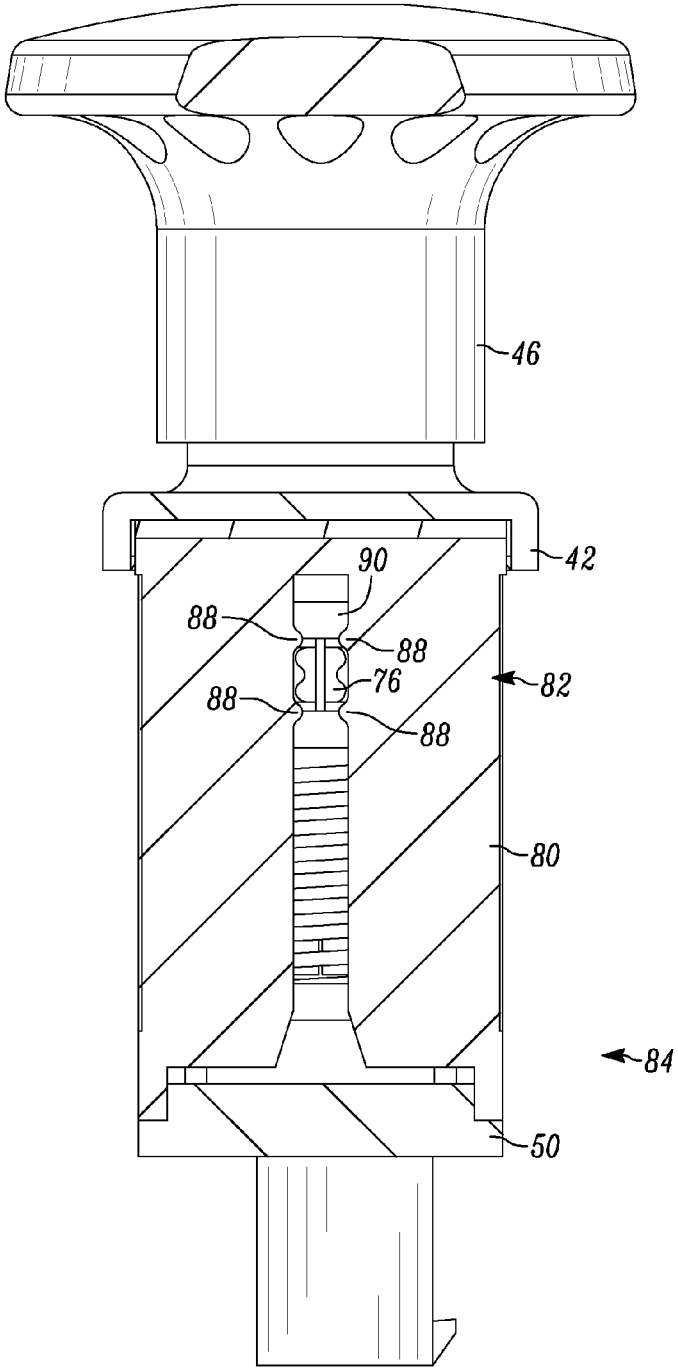
FIG. 17 is a side elevation section view along section lines 17-17 illustrated in FIG. 9.

The knob 46 of the switch assembly 10 is engaged by the user/operator of, for example a lawn tractor to enable cutting blades and/or a power-take-off (PTO) unit by changing the relative location of the knob, plunger arrangement 12, and contact 14 relative to the location of the wipers 18, 20, 22, and 24 that the contact points 30 and 32 engage on the PCB 26 as the knob, plunger arrangement, and contact moves between the down position FIG. 12, middle position FIG. 13, and up position FIG. 14. Thus, the electrical state changes as the switch assembly 10 components are moved as discussed above and shown in FIGS. 12-14 to enable and disable a lawn tractor PTO.

In the illustrated example embodiment of FIGS. 20 and 21, the PCB 26 includes a plurality of terminals 48 that pass through a housing bottom 50 into a connector 52 for attaching, and electrically communicating with a wiring harness (not shown) of the power equipment, such as a lawn tractor, water craft, all-terrain vehicle (ATV), and the like. Such electrical communication includes the alteration of the electrical states, thus controlling the PTO by the component movement of the switch assembly 10 as shown and described herein.

As discussed, one application of the switch assembly 10 includes operating a PTO for a lawn mower, controlling the transfer of power from an engine output shaft to an accessory such as the lawn mower blades. In an exemplary embodiment, the switch assembly 10 operates with an electrical system of lawn mower using approximately 5V and 250 mA. However, it should be appreciated that the switch assembly could accommodate larger or smaller power requirements without departing from the spirit of the present disclosure.

In the illustrated example embodiment, all components of the switch assembly 10 are formed from plastic except for the contact 14, PCB 26, and a spring 54 that is part of the spring assembly 34. However, other materials in of similar weight and strength such as metals could be used without departing from the spirit of the present disclosure. The housing 16 includes a cavity 56 for the movement of the plunger arrangement 12. The housing 16 encloses as least a portion of the plunger arrangement 12 by the seal 38, housing top 42, and housing bottom 50 that snap fit together as appreciated by those skilled in the art.

Centrally passing through the knob 46, and a portion of the shaft 28 of the plunger arrangement 12 is a light pipe 58 that provides an illuminated indicator 60 to the operator as to the electrical state of the PTO. The indicator 60 projects light from the top of the knob 46 and the PCB 26 may or may not provide illumination from an LED (not shown) on the PCB based on the electrical state of the PTO, which as discussed is determined by the position of the components of the switch assembly 10 shown in FIGS. 12-14.

Figure 23:
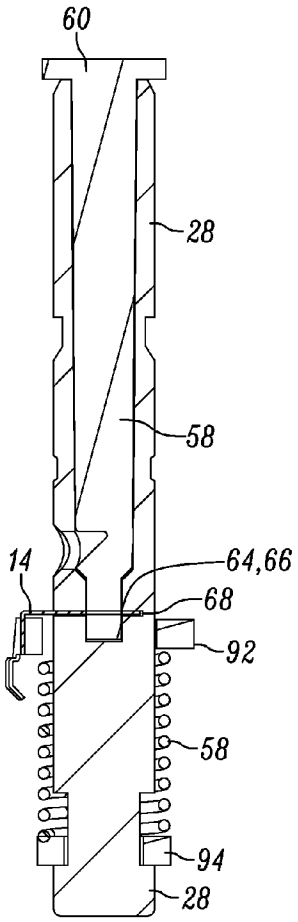
FIG. 23 is a vertical section view of FIG. 22.
Figure 22:
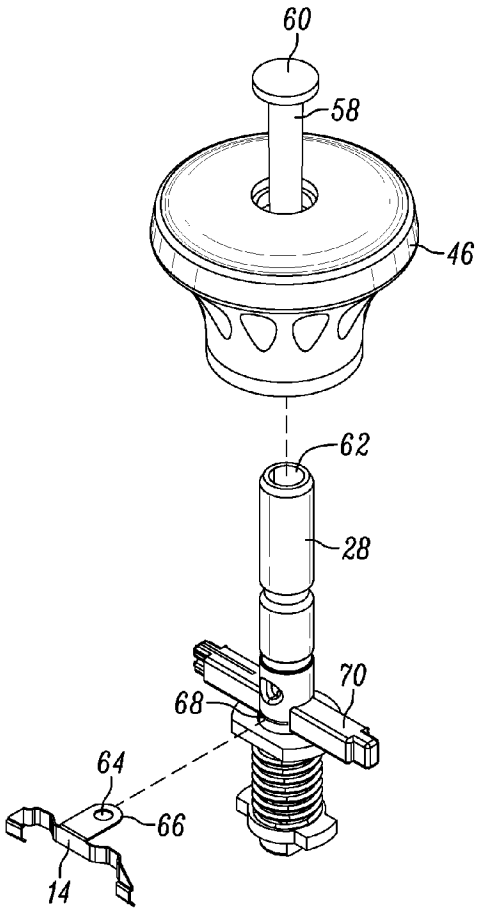
FIG. 22 is an assembly view of a light pipe contact lock in accordance with one example embodiment of the present disclosure.

The light pipe 58 facilitates in the assembly of the plunger arrangement 12, as further illustrated in FIGS. 22 and 23. In particular, the light pipe 58 passes partially through the knob 46 until the indicator 60 is seated into the top thereof. The remaining portion of the light pipe 58 proceeds through a central opening 62 in the plunger arrangement 12 and through an aperture 64 in a tab 66 extending from the contact 14. The tab 66 is inserted through a slot 68 in the perimeter of the shaft 28. Thus, light pipe 58 secures the contact 14 to the plunger arrangement, allowing the contact to be fixedly attached to the shaft 28.

In the illustrated example embodiments, the shaft 28 includes a step shaft 70 having first 72 and second 74 sides. The step shaft 70 is asymmetrical about the shaft 28 such that the first step 72 is longer than the second step 74. Located at the distal portion of the first side 72 is a securing end 76 that advantageously allows the switch assembly 10 to selectably change switch operation modes between a momentary operating condition switch and maintained operating condition. That is, in a momentary operating condition, the switch assembly 10, and particularly the knob 46 after being pulled or pushed by the operator to the up position (FIG. 14) or down position (FIG. 12), the plunger arrangement 12 naturally returns to the middle position (FIG. 13) by the spring momentum of the spring assembly 34 when the knob is released or disengaged by the operator. In a maintained operating condition, the switch assembly 10, and particularly the knob 46 after being pulled or pushed by the operator to the up position (FIG. 14) or down position (FIG. 12), the plunger arrangement 12 is maintained in the up or down position until changed by the operator.

Figure 19:
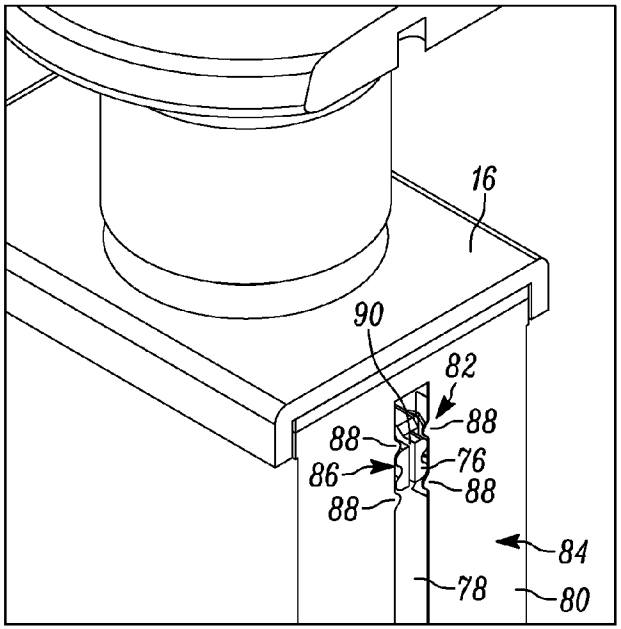
FIG. 19 is a magnified view of FIG. 17.
Figure 18:
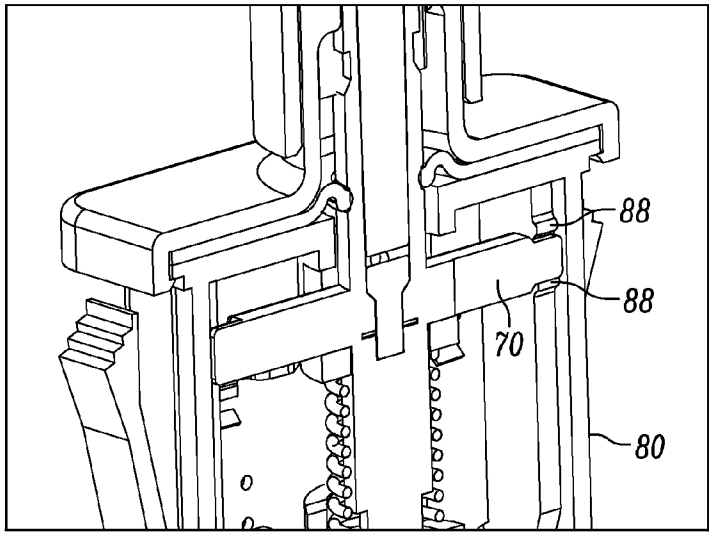
FIG. 18 is a partial sectional view of the switch assembly of FIG. 11.

In order to alter the switch assembly 10 to a maintained operating condition switch assembly, the step shaft 70 is rotated within the housing 16 such that the first side 72 and securing end 76 engages a slot 78 formed in one of the four housing sides 80, as best seen in FIGS. 18 and 19. The slot 78 at an upper and lower ends 82, 84, respectively includes a retaining assembly 86 that further includes four bosses 88 that compress and contain the securing end 76 within the retaining assembly until moved again by the operator. The securing end 76 includes a gap 90 that allows for the compression of the end as it passes through two of the bosses 88 to the retained position shown in FIGS. 18 and 19.

In order to alter the switch assembly 10 to a momentary operating condition switch assembly, the step shaft 70 is rotated within the housing 16 one-hundred and eighty degrees (180°) from the maintained operating condition, so that the second side 74 is too short to engage with the housing 16 slot 78. Thus, the spring assembly 34 returns the plunger assembly 12 to the middle position (FIG. 13) whenever the knob 46 is advanced to the up or down positions of FIGS. 12 and 14. It should be appreciated that the selection between the momentary and maintained positions is selected and achieved during the assembly of the housing 16 and plunger arrangement 12 within the switch assembly 10.

In an alternative example embodiment, the step shaft 70 is symmetrical about the shaft 28. However, the second side 74 of the step shaft 70 is undersized such that the bosses 88 do not retain or interfere with the movement of the second side 74 as it translates within the slot 78 of the housing 16, thus maintaining a momentary operating condition when the second side 74 faces or engages the slot 78 of the housing 16. Similarly, it should be appreciated that in this example embodiment, the selection between the momentary and maintained positions is selected and achieved during the assembly of the housing 16 and plunger arrangement 12 within the switch assembly 10.

Figure 25:
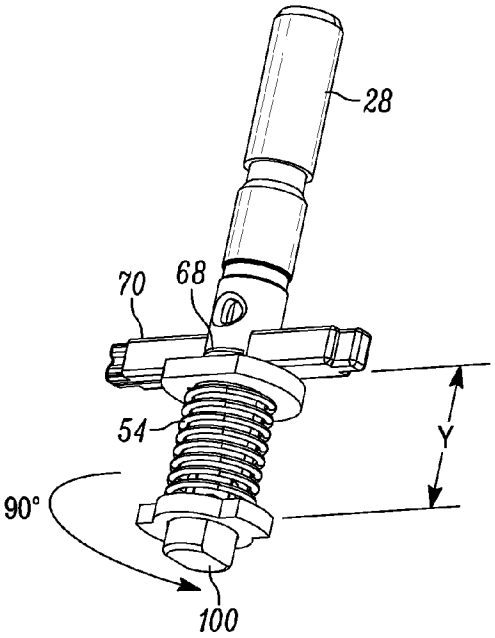
FIG. 25 is an assembly view of the spring lock assembly of FIG. 25.
Figure 24:
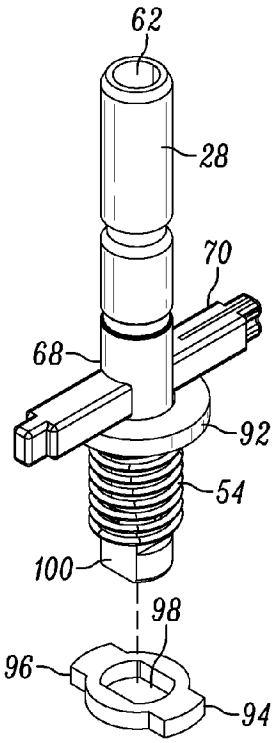
FIG. 24 is a partial assembly view of a spring lock assembly in accordance with one example embodiment of the present disclosure.

Illustrated in FIGS. 24 and 25 is the spring assembly 34, which includes the spring 54, end washer 92, and locking washer 94. The end washer 92 is positioned over a lower end 96 of the shaft 28 until engaging the step shaft 70. The spring is then positioned over the lower end 96 until engaging the end washer 92. The locking washer 94 is then used to secure the spring assembly 34 to the plunger arrangement 12 by passing a conformed opening 98 in the washer over a corresponding profile 100 at the lower end 96 of the shaft 28. The locking washer 94 then compresses the spring 54 until it passes over projecting ends 102 of the corresponding profile 100. The locking washer 94 is then rotated ninety-degrees (90°) (see arrow) and released, as the spring 54 biases flats 104 in the locking washer 94 until the flats engage corresponding projection ends 102, locking the spring assembly 34 to the plunger arrangement 12.

In the illustrated embodiment, a parallel sides are formed by the flats 104 in the conformed opening 98 and parallel end members are formed by the projecting ends 102 and the spring assembly 34 is secured by the construction of the opening formed by the flats 104, which is less than the distanced formed by the projecting ends 102 on the lower end 96 of the shaft 28. It should be appreciated by the construction illustrated in FIGS. 24 and 25 that the spring tension in the spring 54 is set by the distance between the step shaft 70 and the distance to the projecting ends 102. Accordingly, the desired spring tension can he conveniently altered by changing such distance represented by reference character Y.

Illustrated in FIG. 20, the housing bottom 50 includes a container 106 that conforms to the shape of the locking washer 94 and retains the plunger arrangement 12 in place during operation of the switch assembly 10. The container further includes slots 108 that provide for the convenient rotation of the plunger assembly of one-hundred and eighty degrees (180°) so as the allowance of the changing from a momentary operating mode of the switch assembly 10 to a maintained operating mode, as desired by the user.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment, the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A switch assembly comprising:

a housing having top and bottom ends spaced about a longitudinal axis, a selectively movable knob coupled to a plunger arrangement having a shaft that extends from inside said housing to couple to said knob;

a printed circuit board having at least one wiper for engaging contact extending from said plunger arrangement; and a step shaft projecting from the shaft of said plunger arrangement such that when a maintained mode of operation is selected by said switch assembly, said step shaft engages a retaining assembly formed by a portion of said housing, and when a momentary mode of operation is selected by said switch assembly said step shaft is positioned such that it is free from engaging said retaining assembly.

2. The switch assembly of claim 1 further comprising a light pipe that extends through an opening in said plunger arrangement to secure said contact to said plunger arrangement.

3. The switch assembly of claim 1 further comprising a spring assembly, the spring assembly having an end washer, a spring, and a locking washer, the spring assembly configured to set the tension in the plunger arrangement as it moves from a first position to a second position, thus changing an electrical state in the switch during such movement.

4. The switch assembly of claim 1 wherein an asymmetrical construction of the step shaft allows the switch assembly to be selectable between a momentary mode switch and a maintained mode switch.

5. The switch assembly of claim 1 wherein said step shaft further comprises first and second arms asymmetrically extending from said step shaft along a single plane wherein said first arm extends at a different distance than said second arm forming an asymmetrical construction.

6. The switch assembly of claim 1 wherein said retaining assembly comprises a slot within one side of a plurality of sides forming the housing, said slot for guiding and supporting one of first and second arms of the step shaft, said first and second arms oppositely extending from the step shaft to allow the passage of at least one of the first and second arms to engage said retaining assembly formed in said slot when said switch is in a maintained mode of operation.

7. The switch assembly of claim 6 wherein said retaining assembly comprises a plurality of bosses projecting to reduce the opening in said slot and to engage at least one of said first and second arms when said switch is in a maintained mode of operation.

8. The switch assembly of claim 1 wherein said step shaft further comprises first and second arms symmetrically extending from said step shaft along a single plane wherein said first arm has a thickness greater than said second arm to allow said first arm to engage said retaining assembly in a maintained mode of operation and the second arm having a smaller thickness to allow the second arm to be free from engagement of said retaining assembly in a momentary mode of operation.

9. The switch assembly of claim 1 wherein said shaft further comprises a light pipe extending through a central opening in said shaft, said light pipe providing illumination to project from an aperture of said moveable knob based on the state of said at least one wiper coupled to said printed circuit board when engaging said contact.

10. The switch assembly of claim 9 wherein said contact secures said light pipe to said shaft.

11. A method of constructing a switch assembly to operate between a maintained operating mode and a momentary operating mode, the method comprising the steps of:

providing a housing having top and bottom ends spaced about a longitudinal axis, attaching a selectively movable knob to a plunger arrangement having a shaft that extends from inside said housing;

securing a contact to said shaft for selectively engaging a wiper on a printed circuit board, the contact being in a momentarily engaged mode or in a maintained engaged mode based on the orientation of a step shaft projecting from the shaft when the switch assembly is assembled; and selectively orienting said step shaft to engage with a retaining assembly formed by a portion of said housing in a maintained mode of operation of said switch assembly, wherein the step shaft engages the retaining assembly until disengagement is selected, or selectively orienting said step shaft freely from engaging said retaining assembly in a momentary mode of operation of said switch assembly, wherein the step shaft recoils from the retaining assembly.

12. The method of claim 11 further comprising the step of extending a light pipe through an opening in said plunger arrangement to secure said contact to said plunger arrangement.

13. The method of claim 11 further comprising the step of providing a spring assembly, the spring assembly having an end washer, a spring, and a locking washer, the spring assembly configured to set a tension in the plunger arrangement as it moves from a first position to a second position, thus changing an electrical state in the switch during such movement.

14. The method of claim 11 further comprising the step of providing said step shaft such that it is an asymmetrical step shaft allowing the switch assembly to be selectable between a momentary mode switch and a maintained mode switch.

15. A switch assembly comprising:

a housing forming a cavity spaced about a longitudinal axis, a selectively movable knob coupled to a plunger arrangement having a shaft that extends from inside said housing to couple to said knob;

a printed circuit board having at least one wiper for engaging a contact extending from said plunger arrangement; and an asymmetrical step shaft comprising first and second arms of differing length projecting from the shaft of said plunger arrangement such that when a maintained mode of operation is selected by said switch assembly, said first arm of said step shaft having a greater length than said second arm engages a retaining assembly formed in one of a plurality of walls forming said cavity of said housing, and when a momentary mode of operation is selected by said switch assembly said second arm of said step shaft having a lesser length than said first arm is positioned such that it is free from engaging said retaining assembly.

16. The switch assembly of claim 15 further comprising a light pipe that extends through an opening in said plunger arrangement to secure said contact to said plunger arrangement.

17. The switch assembly of claim 15 further comprising a spring assembly, the spring assembly having an end washer, a spring, and a locking washer, the spring assembly configured to set a tension in the plunger arrangement as it moves from a first position to a second position, thus changing an electrical state in the switch during such movement.

18. The switch assembly of claim 15 wherein a light pipe secures said contact to said shaft.

19. The switch assembly of claim 15 wherein said retaining assembly comprises a slot within one side of a plurality of sides forming the housing, said slot for guiding and supporting one of first and second arms of the step shaft, said first and second arms oppositely extending from the step shaft to allow the passage of said at least one of the first and second arms to engage said retaining assembly formed in said slot when said switch is in the maintained mode of operation.

20. The switch assembly of claim 19 wherein said retaining assembly comprises a plurality of bosses projecting to reduce the opening in said slot and to engage at least one of said first and second arms when said switch is in a maintained mode of operation.

* * * * *